United States Patent [19]

Ishikawa

[11] 4,382,622

[45] May 10, 1983

[54] DOOR LOCK FOR VEHICLE

[75] Inventor: Yoshiaki Ishikawa, Aichi, Japan

[73] Assignee: Aisin Seiki Kabushiki Kaisha, Kariya, Japan

[21] Appl. No.: 147,249

[22] Filed: May 6, 1980

[30] Foreign Application Priority Data

May 10, 1979 [JP] Japan ..... 54-57539

[51] Int. Cl.[3] ..... E05C 3/06

[52] U.S. Cl. ..... 292/216; 292/DIG. 39; 292/DIG. 65

[58] Field of Search ..... 292/216, DIG. 65, DIG. 39; 296/146, 35.2

[56] References Cited

U.S. PATENT DOCUMENTS

| | | | |
|---|---|---|---|
| 2,582,167 | 1/1952 | Santosuosso | 296/146 X |
| 3,334,934 | 8/1967 | Sandor | 292/229 X |
| 3,501,189 | 3/1970 | Vik | 292/216 |
| 3,599,743 | 8/1971 | Hull | 292/216 X |
| 3,788,686 | 1/1974 | Rossie | 292/DIG. 39 X |
| 3,819,228 | 6/1974 | Cornacchia | 292/DIG. 65 X |
| 4,013,317 | 3/1977 | Reidelbach | 296/146 |
| 4,027,432 | 6/1977 | Klebba | 296/146 X |

FOREIGN PATENT DOCUMENTS

| | | | |
|---|---|---|---|
| 2014574 | 3/1970 | Fed. Rep. of Germany | |
| 2804603 | 8/1978 | Fed. Rep. of Germany | 296/146 |
| 2372067 | 7/1978 | France | 296/146 |

*Primary Examiner*—J. Franklin Foss

*Attorney, Agent, or Firm*—Oblon, Fisher, Spivak, McClelland & Maier

[57] ABSTRACT

Vehicle door is secured to be closed on side collision by an engagement of an extending arm extending from a pawl lever or link means for door closure latch with a projecting members mounted inside of an outer door panel, enabling a safety door lock for vehicle which prevents a passenger from being thrown out on the collision.

13 Claims, 6 Drawing Figures

DOOR LOCK FOR VEHICLE

BACKGROUND OF THE INVENTION

Field of the Invention

The present invention relates to a door lock for vehicle, particularly that susceptible of preventing a vehicle door from opening upon a side collision.

Description of the Prior Art

There arises a danger on a car collision, especially upon a side collision, that a passenger would be thrown out of the vehicle as the door is unlatched so as to open due to the impact of collision or deflection of the door, particularly the linking mechanism for outer and inside door handle. On collisions, such linking mechanisms would be effected so as to release a door closure latch to open the door since the linking mechanism includes rods bars, or levers linking to a latch member like a pawl lever, which linkage is likely to release upon collision due to the impact or deflection of link members.

SUMMARY OF THE INVENTION

It is an object of the present invention to provide a novel door lock or latch which eliminates such danger.

The object of the present invention is realized by the features as recited hereinbelow. The conventional door latch or closure mechanism for automobiles include a lever member or lever members (a link mechanisms hereinafter) which are under the unlached normal condition freely swung to release the door latch operated by an outer door handle or push button thereof or an inside door handle provided the link mechanisms are released from a locking condition by a door key or an inner door lock knob.

In the present invention the link mechanisms and/or pawl lever operable to release the door latch further include such mechanism as adapted to prevent the link mechanism and/or pawl lever from a movement in its releasing direction, thus preventing the door from being unlatched and opening so that the passenger is protected against being thrown out of the automobile.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
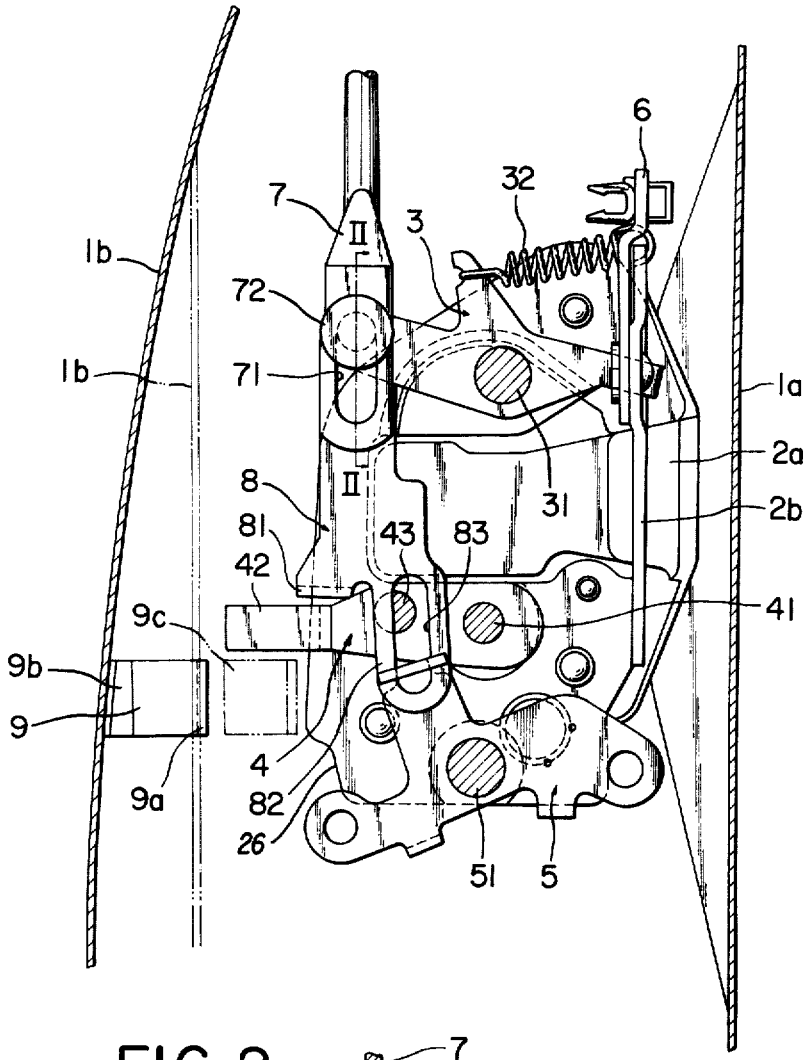
FIG. 1 is a sectional view of the door lock portion of the door showing an embodiment of the present invention.
Figure 2:
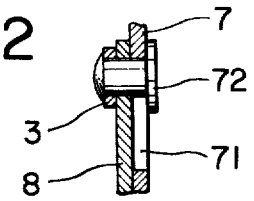
FIG. 2 is a partial sectional view taken along the line II—II in FIG. 1.

Referring to FIG. 1 showing a preferred embodiment of the present invention, an automobile door includes an inner panel 1*a* and an outer panel 1*b* interspaced therefrom, and a closure latch base plate 2*a* and a subplate 2*b* which are fixed to the inner panel 1*a* on its inner side. On the base plate 2*a*, an open lever 3 on a pawl lever 4 are pivotally mounted by a pin 31 and a pin 41, respectively, while a locking lever 5 is pivoted on the subplate 26 by a pin 51. The open lever 3 at its one end engages with an inside link arm 6 movable upwardly and downwardly and operatively connected with an inside door handle (not shown), while an opposite end of the open lever 3 is pivotally supported by a pin 72 inserted in a slot 71 of an outer link lever 7. The outer link lever 7 is operated upwardly and downwardly in operative connection with an outer door handle (not shown). A spring 32 clockwise biasing the open lever 3 is hooked over between the open lever 3 and the upper end of the inside link arm 6.

The upper end of an intermediate link 8 is pivoted by a pin 72 which pivots one end of the open lever 3. An opposite lower end of the intermediate link 8 is extended to form a projection 81, whereas another projection 82 downwardly extends from the lower end parallel to the projection 81 to form one leg of a bifurcation.

The pawl lever 4 underlies the intermediate link 8, and the pawl lever 4 is provided with a pawl (not shown) on the rear side thereof at a pawl lever end towards the inner panel 1*a*, which pawl retains a latch engageble with a striker mounted on the vehicle body in a latched position. In FIG. 1, the door is in the closed position and the pawl lever 4 is in a latched position, whereas the pawl lever 4 is released (unlatched) the pawl lever 4 swings counterclockwise. An extending arm (projection) 42 is formed towards the outer door panel 1*b* extending from one end towards the outer door panel 1*b* of the pawl lever 4. Intermediate link 8 is located in front of the pawl lever 4 in FIG. 1, and the lower end projection 81 of the intermediate link 8 is right-angularly bent towards the pawl lever 4 while the extending arm 42 of the pawl lever 4 is right-angularly bent to the intermediate link 8, thus enabling the pawl lever 4 to be pushed down upon downward movement of the end projection 81 by its engagement with the extending arm 42 of the pawl lever 4, which downward movement of the end prejection 81 causes the pawl lever 4 to swing counterclockwise, i.e. in a unlatching direction.

In a slot 83 formed on the lower end projection 82 of the intermediate link 8, an upper extending arm end of the locking lever 5 is slidably inserted and engaged therewith. This locking lever 5 is operated by means of an inside door lock knob located inside of the door or a door key operated outside thereof (both not shown), the locking lever 5 being clockwise swung upon clockwise rotation of the key whereas such is swung counterclockwise upon on counterclockwise rotation thereof. In FIG. 1, unlocked positions of the locking lever 5 and relating members are shown. On locking operation of the inside door lock knob or door key, the locking lever 5 is swung clockwise, whereby the intermediate lever 8 is swung clockwise causing the end projection 81 to move towards the inner panel 1*a* (to the right in FIG. 1).

Inside of the outer door panel 1b, a projecting member 9 is fixed on a fixing base 9b vertically underlying the extending arm 42 of the pawl lever 4 and horizontally with an optimal small distance from an outer panel end of the extending arm 42.

In the following discussion, the operation of the present embodiment is described. In FIG. 1, the door is closed, the pawl lever 4 is in the latched position, and the locking lever 5 is in the unlocked position. Upon the outer door handle being operated to open the door (to unlatch the closure latch), the outer link 7 moves downwardly, thereby causing the intermediate link 8, which is by the pin 72 pivotally slot-engaged with the outer link lever 7, to move downwardly. Lower end projection 81 of the link lever 8 downwardly pushes the extending arm 42 of the pawl lever 4, which causes the pawl lever 4 to swing counterclockwise and release the latch (e.g. release the pawl from the latched position), thus permitting the door to open. Provided that the inside door handle is operated for release, the inside link arm 6 moves upwardly to lift the inner (right in FIG. 1) end of the open lever 3, downwardly swinging the opposite outer end thereof engaged with the intermediate lever 8 by the pin 72, whereby the pawl lever 4 is released to be unlatched in the same manner as the outer handle operation.

If the latch is locked by the key or inside door lock knob, the locking lever 5 is swung clockwise from the position as shown in FIG. 1 simultaneously rightwardly to move the upper extending arm end thereof engaged with the lower end slot 83 of the intermediate link 8. This movement causes the intermediate link 8 to swing counterclockwise, simultaneously rightwardly swinging the lower end projection 81, whereby the end projection 81 reaches a position distant and free from the extending arm 42 of the pawl lever 4, i.e. a released position. Thus the intermediate lever 8 would not engage with the pawl lever 4 even when the outer or inside door handle is operated downwardly by pushing the intermediate link 8, i.e. such comes to an idling condition free from any engagement with the pawl lever 4. In this position, the pawl lever 4 cannot be released to permit the door to open under a normal condition.

Now, upon a side collision of the vehicle at the door, the outer link lever 7 and/or the intermediate link 8 are operable by the impact against or the deflection of the door causing the pawl lever 4 to release or the locking lever 5 to release even when the locking lever 5 had been locked. Upon such occurrence, there arises the danger that the passenger might be thrown out of the vehicle through the opened door.

In the present invention, the projecting member 9 mounted inside of the outer panel 1b is inwardly moved to a position 9c as indicated in FIG. 1 by a double-dotted chain line underlying the extending arm 42 of the pawl lever 4, if the outer door panel 1b is so deflected as shown by a double-dotted chain line 1b. Thus the pawl lever 4 would not be released since such is engagingly retained by the inwardly pushed projecting member 9c, even if the intermediate lever 8 would move downwardly to cause its lower end projection 81 to engage the extending arm 41 of the pawl lever 4. Accordingly, locking of the pawl lever 4 can be secured to prevent the door from opening. For better engagement of the both engaging members, a right-angularly bent portion 9a is formed at an inner end of the projecting member 9.

Figure 3:
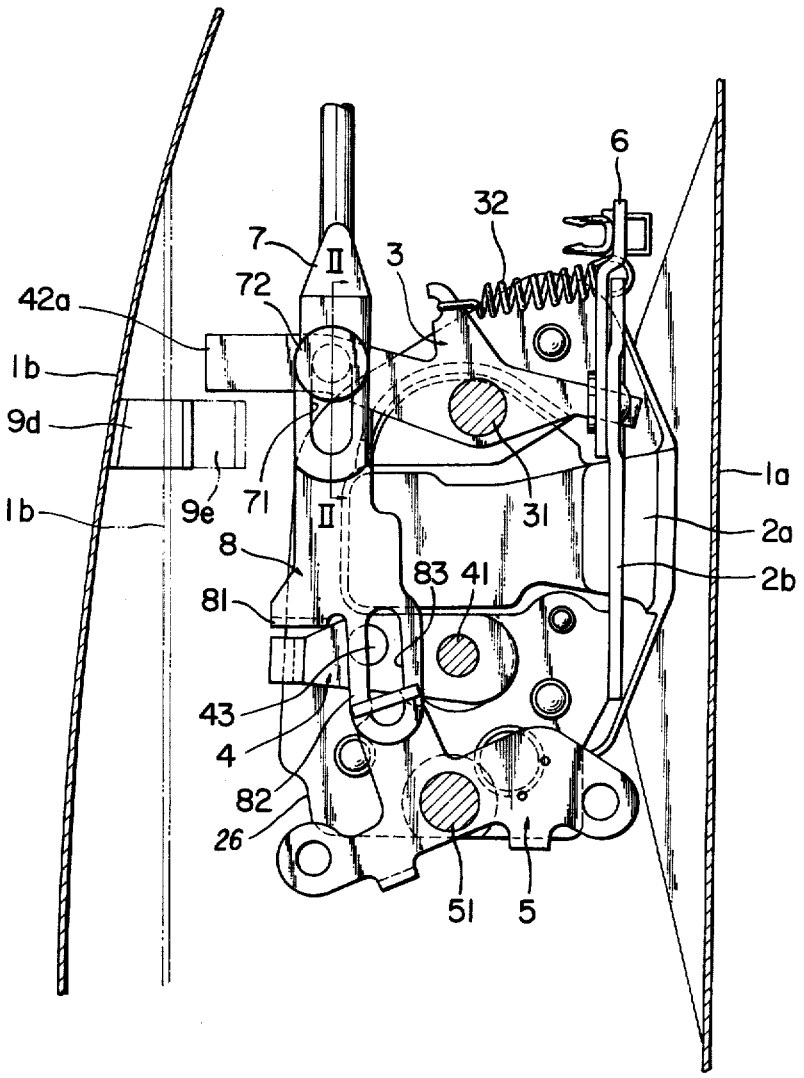
FIG. 3 is a sectional view thereof showing a second embodiment.

In FIG. 3, a second embodiment of the present invention is shown. Though the pawl lever 4 is provided with the extending arm 42 thereof engageable with the projecting member 9 of the outer door panel in the first embodiment as shown in FIG. 1, a similar extending arm 42a can be formed at the outer end of the open lever 3, and a corresponding projecting member 9d can be mounted the same positional relationship as in FIG. 1, which is shown in FIG. 3 and enabling a similar operation, i.e. upon an inward deflection of the outer panel 1b, the projecting member 9d reaches a position 9e in FIG. 3 underlying the extending arm 42a of the open lever 3 in such a manner as to prevent its latch-releasing movement.

Figure 4:
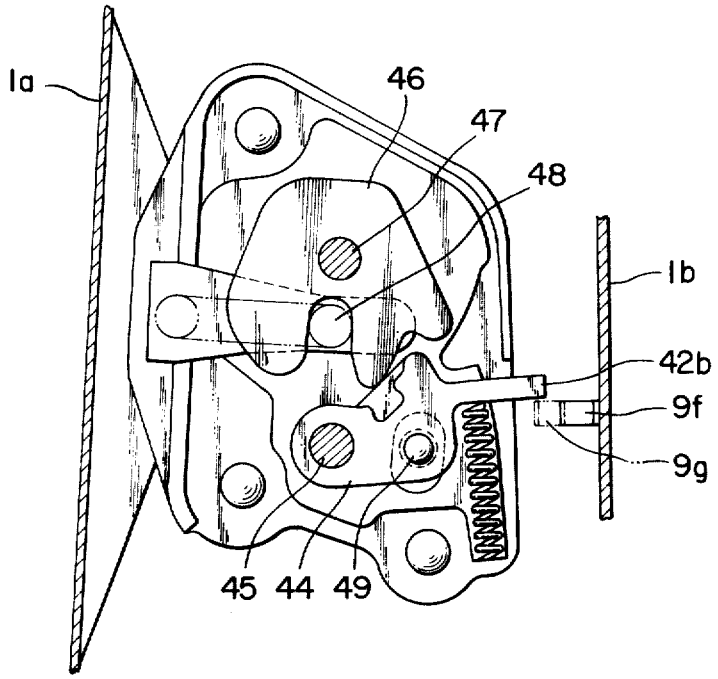
FIG. 4 is a sectional view of the door latch portion of the door showing a third embodiment.

Referring to the FIG. 4, a third embodiment of the present invention is shown, which includes a latch structure applicable to the reverse side of the pawl lever to shown in FIG. 1 while a pin 49 corresponds to the pin 43 in FIG. 1, both pins 45 and 49 operatively connecting the pawl lever in FIG. 1, with the pawl 44. Pawl 44 pivoted by the pin 45, which is engageable with a latch bolt 46 pivoted by the pin 47, is provided with an extending arm 42b at the outer end of the pawl 44, while a projecting member 9f is mounted at a position corresponding thereto inside of the outer panel 1b. Upon deflection of the outer panel 1b, the projecting member 9f reaches the position 9g to prevent the pawl 44 from being released.

Figure 5:
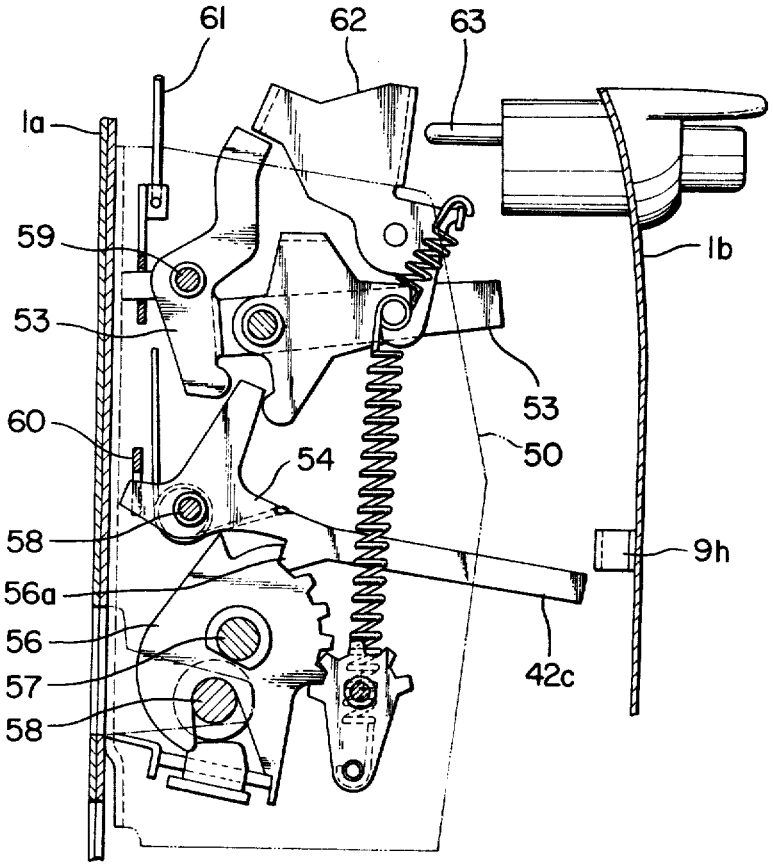
FIG. 5 is a sectional view thereof showing a fourth embodiment.
Figure 6:
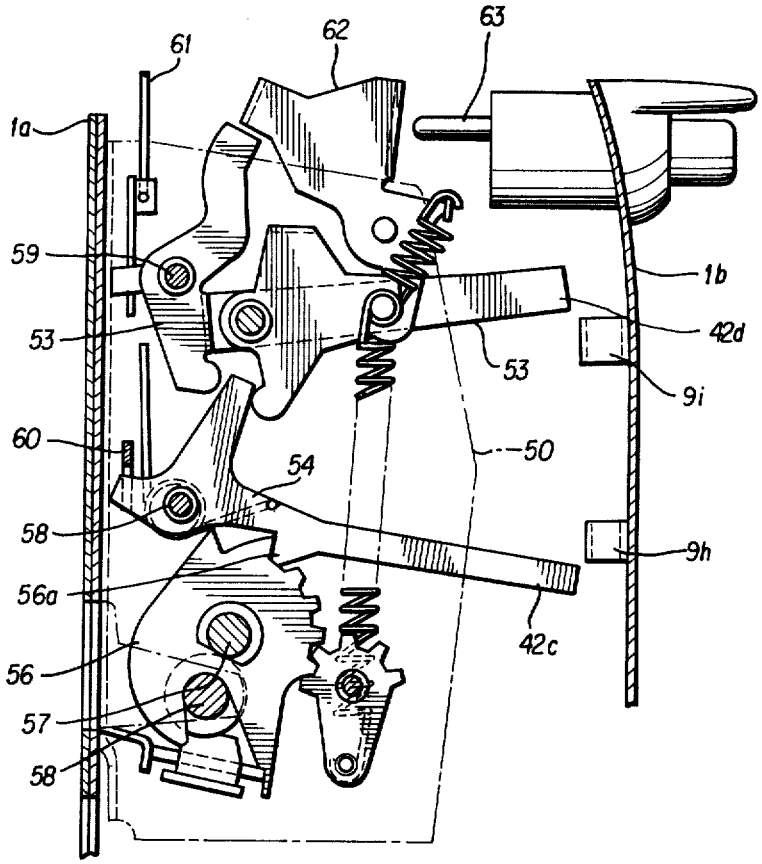
FIG. 6 is a sectional view showing a fifth embodiment.

A further embodiment is shown in FIG. 5 which is based on the door closure latch 50 as disclosed in the U.S. Pat. No. 3,334,934, the detailed disclosure of the closure latch 50 per se being hereby incorporated in the present specification by reference thereto. An extending arm 42c is formed at an outer end of a pawl lever (detent lever) 54 pivoted by a pin 58 and engageable with a shoulder 56a of a latch bolt 56 which is pivoted by a pin 57 and engageable with a striker 58 mounted on the vehicle body, while a projecting member 9h is correspondingly mounted inside of the outer panel 1b thereon. Alternatively or additionally, a blocking lever 53 which blocks and releases the pawl lever 54 and pivoted by a pin 59 can be provided with an extending arm 42d, while a projecting member 9i can be correspondingly mounted inside of the outer panel 1b (FIG. 6). Pawl lever 54 is operatively connected with an inside door handle link lever 60 and the blocking lever 53 is operatively connecting on one hand to a door lock knob (inside) through a door lock remote control link 61 and, on the other hand, to an outer door handle push rod 63 through a holding lever 62.

Accordingly, the term "pawl lever" in the present invention is construed to include also a pawl per se because a pawl lever may be operatively connected with the pawl or operatively solid or integral with the pawl.

As disclosed hereinabove, the present invention provides a new door lock enabling a secured restraint from the door opening upon the side collision by applying the conventional door latches and additionally applying an extending arm of the lever member and the corresponding projecting member inside of the outer panel, both being engageable each other on a collision, which eliminates the passenger's danger to be thrown out of the vehicle upon a collision without further complication of the conventional latch structure.

Obviously, numerous modifications and variations of the present invention are possible in light of the above teachings. It is therefore to be understood that within the scope of the appended claims, the invention may be practiced otherwise than as specifically described herein.

What is claimed is:

1. A door lock for a vehicle having a door latch engageable with a striker mounted on the vehicle body in a latched position comprising:

an outer panel having a projecting member extending inwardly therefrom;

an inner panel member;

latching-releasing means positioned between said inner and outer panel members operatively connected to said door latch; and projection means operatively associated with said latching-releasing means for engagement with said projecting member for releasing said latching-releasing means from a latch position upon inward deflection of said outer panel.

2. A door lock as set forth in claim 1, further comprising:

an outer door handle wherein said latching-releasing means further comprises pawl means which includes a pawl lever and a pawl connected to said pawl lever; and link means operatively connected to said door handle and said pawl lever for releasing engagement between said pawl and said latch and wherein said projection means further comprises an arm extending outwardly towards said outer panel from said pawl member such that said projection member is engageable with said projection means upon inward deflection of said outer panel.

3. A door lock as set forth in claim 2, wherein said projecting member further comprises a bent portion for engaging with the arm of the pawl lever upon inward deflection of the outer panel.

4. The door lock as set forth in claim 2, wherein said pawl is operatively integrally connected with said pawl lever.

5. A door lock as set forth in claim 2, wherein said pawl and said pawl lever comprise a one-piece pawl member.

6. A door lock as set forth in claim 1, further comprising an outer door handle and an inner door handle wherein said latching-releasing means further comprises pawl means which include a pawl lever and a pawl connected to said pawl lever; and link means operatively connected to said inner and outer door handle for releasing engagement between said pawl and said latch according to operation of said inner and outer handle and wherein said projection means further comprises an arm extending outwardly from said link means such that said projection member is engageable with said projection means upon inward deflection of said outer panel.

7. A door lock as set forth in claim 6, wherein said link means further comprises an inner and outer handle link means and at least one intermediate link member operatively connected to said outer handle link means and an open lever operatively connected to said intermediate link member and comprising an element of said inside handle link means.

8. A door lock as set forth in claim 7, wherein said arm extends from said open lever.

9. A door lock as set forth in claim 2, wherein said link means further comprises a blocking lever and a holding lever wherein said holding lever is connected to said blocking lever and said blocking lever and said holding lever are operatively associated with said pawl means, and a latch bolt engageable with said pawl means.

10. A door lock as set forth in claim 9, wherein said projection means further comprises an arm extending outwardly toward said outer panel from said blocking lever such that said projection member is engageable with said projection means upon inward deflection of said outer panel.

11. A door lock for a vehicle having a door latch, a vehicle body, an outer door panel, an outer door handle and an inside door cancel, comprising:

a projecting member provided on the inner side of the outer panel;

a striker;

a pawl holding said door latch engageable with said striker mounted on said vehicle body in a latched position;

latching-releasing means for the pawl provided on the door inside said outer door panel wherein the latching-releasing means further comprises a pawl member supporting the pawl and defining its movement; and link means operatively connected with said pawl lever for releasing engagement between said pawl and said latch according to operation caused by said outer door handle or said inner door handle wherein the latching-releasing means further comprises an arm extending towards the outer panel and wherein said projecting member is provided on the inner side of said outer panel so that said projecting member is engageable with the arm to restrain the pawl lever from being released from a latched position thereof.

12. A door lock of claim 11, wherein said arm further comprises a second pawl lever.

13. The door lock of claim 11, wherein said arm further comprises lever means which comprise a part of the link means.

* * * * *